US009799473B2

(12) United States Patent
Jung

(10) Patent No.: US 9,799,473 B2
(45) Date of Patent: Oct. 24, 2017

(54) BYPASS SWITCH FOR HVDC TRANSMISSION

(71) Applicant: LSIS CO., LTD., Anyang-si, Gyeonggi-do (KR)

(72) Inventor: Teag Sun Jung, Hanam-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/812,893

(22) Filed: Jul. 29, 2015

(65) Prior Publication Data

US 2016/0203929 A1 Jul. 14, 2016

(30) Foreign Application Priority Data

Jan. 12, 2015 (KR) ..... 10-2015-0004380

(51) Int. Cl.

*H01H 39/00* (2006.01)
*H01H 33/666* (2006.01)
*H01H 79/00* (2006.01)

(52) U.S. Cl.

CPC ..... *H01H 39/002* (2013.01); *H01H 39/004* (2013.01); *H01H 33/666* (2013.01); *H01H 79/00* (2013.01); *H01H 2239/044* (2013.01)

(58) Field of Classification Search

CPC ..... H01H 39/002; H01H 39/004; H01H 2239/044; H01H 33/666; H01H 79/00;
(Continued)

(56) References Cited

U.S. PATENT DOCUMENTS 5,564,747 A * 10/1996 Ono ..... G01P 15/036 102/272
6,657,150 B1 * 12/2003 Shea ..... H01H 3/3031 218/154

(Continued)

FOREIGN PATENT DOCUMENTS

CN 1672228 A 9/2005
CN 102227797 A 10/2011

(Continued)

OTHER PUBLICATIONS

European Patent Office Application Serial No. 15179780.0, Search Report dated May 24, 2016, 7 pages.

(Continued)

*Primary Examiner* — Anatoly Vortman
*Assistant Examiner* — Stephen Sul
(74) *Attorney, Agent, or Firm* — Lee, Hong, Degerman, Kang & Waimey PC

(57) ABSTRACT

A bypass switch for high voltage direct current (HVDC) transmission is provided. The bypass switch includes a housing, a fixed contactor disposed in the housing and electrically connected to a first portion of a HVDC transmission circuit, a movable contactor movably disposed in the housing at a position spaced apart from the fixed contactor and electrically connected to a second portion of the HVDC transmission circuit, an insulation member coupled to a side of the movable contactor, an explosive actuator disposed at one side of the insulation member and exploded according to an electrical signal, and a piston mechanism which is moved by the force of gas generated due to the explosion of the explosive actuator, applies force to move the insulation member, and allows the fixed contactor and movable contactor to be electrically connected to each other.

18 Claims, 10 Drawing Sheets

(58) Field of Classification Search
CPC .. H01H 85/00; H01H 2037/762; H01H 37/76; H01H 37/767; H01H 39/00; H01H 73/34; H01H 9/22
USPC ..... 200/48 R; 337/171, 6, 5, 411, 205, 222, 337/227, 31, 168
See application file for complete search history.

(56) References Cited

U.S. PATENT DOCUMENTS

| | | | | |
|---|---|---|---|---|
| 8,390,968 | B2 | 3/2013 | Dorn et al. | |
| 2001/0025830 | A1* | 10/2001 | Allard | H01H 1/5822 218/118 |
| 2006/0027120 | A1* | 2/2006 | Smith | F42B 3/006 102/202.12 |
| 2010/0118453 | A1 | 5/2010 | Dorn et al. | |
| 2010/0219162 | A1 | 9/2010 | Gentsch | |
| 2011/0057762 | A1* | 3/2011 | Burger | H01H 33/666 337/401 |
| 2011/0226740 | A1 | 9/2011 | Anheuer et al. | |
| 2011/0315662 | A1* | 12/2011 | Byron | H01H 33/66 218/140 |
| 2014/0145321 | A1* | 5/2014 | Monge | H01H 79/00 257/683 |

FOREIGN PATENT DOCUMENTS

| | | |
|---|---|---|
| JP | 07-105796 | 4/1995 |
| JP | 2010524426 | 7/2010 |
| JP | 2010538431 | 12/2010 |
| JP | 2011510440 | 3/2011 |
| KR | 10-2009-0121589 | 11/2009 |
| KR | 10-2010-0115742 | 10/2010 |
| KR | 10-2011-0091520 | 8/2011 |
| WO | 2009/092621 | 7/2009 |
| WO | 2010/060790 | 6/2010 |

OTHER PUBLICATIONS

Korean Intellectual Property Office Application Serial No. 10-2015-0004380, Office Action dated Nov. 26, 2015, 5 pages.

Japan Patent Office Application No. 2015-161081, Office Action dated Oct. 25, 2016, 2 pages.

China Patent Office Application No. 201510717273.2, Office Action dated May 31, 2017, 6 pages.

* cited by examiner

BYPASS SWITCH FOR HVDC TRANSMISSION

CROSS-REFERENCE TO RELATED APPLICATIONS

Pursuant to 35 U.S.C. §119(a), this application claims the benefit of earlier filing date and right of priority to Korean Patent Application No. 10-2015-0004380, filed on Jan. 12, 2015, the contents of which are hereby incorporated by reference herein in its entirety.

BACKGROUND

The present disclosure relates to a bypass switch, and particularly, to a high-speed short-circuit bypass switch for high voltage direct current transmission.

High voltage direct current (HVDC) transmission refers to an electric power transmission method in which alternating current (AC) power generated from a power plant is converted into direct current (DC) power and transmitted by a transmission substation, and the transmitted DC power is then converted into AC power again in a receiving substation to supply the power.

HVDC transmission systems are applied to submarine cable transmission, long distance bulk transmission, interconnection between AC systems, and the like. Also, the HVDC transmission systems enable interconnection between systems having different frequencies and asynchronous interconnection.

The transmission substation converts AC power into DC power. That is, since the situation in which AC power is transmitted by using submarine cables and the like is very dangerous, the transmission substation converts the AC power into DC power and then transmits the DC power to a receiving substation.

Also, a high-speed short-circuit bypass switch of a high voltage direct current transmission system shorts a sub-module, when an abnormality such as a failure of the sub-module is detected in a system including a combination of sub-modules, and prevents the effect of the failure from being propagated to other adjacent sub-modules.

Since the high-speed short-circuit bypass switch should finish its operation in a short time, it should be designed as a structure which may be operated at an ultra high speed.

U.S. Pat. No. 8,390,968 discloses a switch, which is operated by allowing current to flow through a coil installed in an operating direction and generates electromagnetic force to operate the switch. However, since the size of the coil becomes greater in such a structure, the volume of the switch is increased and may not be operated at a high speed.

SUMMARY

Embodiments provide a high-speed short-circuit bypass switch operating at a high speed.

Embodiments also provide a bypass switch manufactured to have a small volume.

In one embodiment, a bypass switch for high voltage direct current (HVDC) transmission includes: a housing; a fixed contactor disposed in the housing and electrically connected to a first portion (not shown) of an HVDC transmission circuit; a movable contactor movably disposed in the housing at a position spaced apart from the fixed contactor and electrically connected to a second portion of the HVDC transmission circuit; an insulation member coupled to the movable contactor; an explosive actuator exploded according to an electrical signal; and a piston mechanism which is moved by the force of gas generated due to explosion of the explosive actuator, applies force to move the insulation member, and allows the fixed contactor and movable contactor to be electrically connected to each other.

The piston mechanism may include a piston member moved by the gas; and a magnetic member transferring force, which is applied by the piston member, to the insulation member between the insulation member and the piston member.

The explosive actuator may include an inflator injecting gas, and an inflator cover coupled to the inflator, wherein the inflator cover may include an inner space in which the gas injected from the inflator flows to the piston member and the piston member is movably disposed.

The bypass switch may further include a magnet for holding the magnetic member such that the movable contactor is spaced apart from the fixed contactor before the explosive actuator operates.

The magnetic member may be provided to have a cylindrical shape, and the magnet may be provided to have a shape of a hollow cylinder such that the magnetic member is disposed therein.

The bypass switch may further include a frame defining a space accommodating the housing, and the magnet may be disposed in the frame.

The bypass switch may further include a spring disposed around the magnet and applying force to the insulation member.

The bypass switch may include a first frame, a second frame, a third frame coupled to the fixed contactor and supported by the first and second frames, and a fourth frame coupled to the explosive actuator and supported by the first and second frames.

The magnet may be coupled to and supported by the fourth frame, and the spring may be disposed between the insulation member and the fourth frame.

The bypass switch may further include a first bussbar electrically connected to the fixed contactor, and a second bussbar electrically connected to the movable contactor.

The second bussbar may be disposed between the movable contactor and the insulation member and contact the movable contactor and the insulation member.

The insulation member may include a protrusion which penetrates a through hole formed in the second bussbar and is coupled to an insertion groove formed in the movable contactor.

The housing may be a vacuum housing and may further include a bellows disposed in the housing between the movable contactor and the housing.

The vacuum housing may be formed of an insulation material.

The fixed contactor and movable contactor may include an inner plate disposed inside the housing, an outer connection part which protrudes from the inner plate and is exposed to the outside of the housing.

The bypass switch may further include a frame defining a space accommodating the housing, and the explosive actuator may be disposed in the frame.

In another embodiment, a bypass switch for high voltage direct current (HVDC) transmission includes: a frame defining a space therein; a housing disposed in the space; a fixed contactor disposed in the housing; a first bussbar connected to the fixed contactor; a movable contactor movably disposed in the housing at a position spaced apart from the fixed contactor; a second bussbar connected to the movable contactor; an insulation member coupled to the movable contactor; an explosive actuator disposed in the frame and exploded according to an electrical signal; a piston mechanism which is moved by the force of gas generated due to the explosion of the explosive actuator, applies force to move the insulation member, and allows the movable contactor to make contact with the fixed contactor; and a spring disposed between the insulation member and the frame and applying force to the insulation member.

The frame may include a through hole into which a portion of the explosive actuator is inserted.

The piston mechanism may include a piston member moved by the gas; and a magnetic member transferring force, which is applied by the piston member, to the insulation member between the insulation member and the piston member.

The bypass switch may further include a magnet, disposed in the frame and holding the magnetic member such that the movable contactor is spaced apart from the fixed contactor before the explosive actuator operates.

The spring may be positioned at an outer circumferential surface of the magnet.

The details of one or more embodiments are set forth in the accompanying drawings and the description below. Other features will be apparent from the description and drawings, and from the claims.

DETAILED DESCRIPTION OF THE EMBODIMENTS

Figure 1:
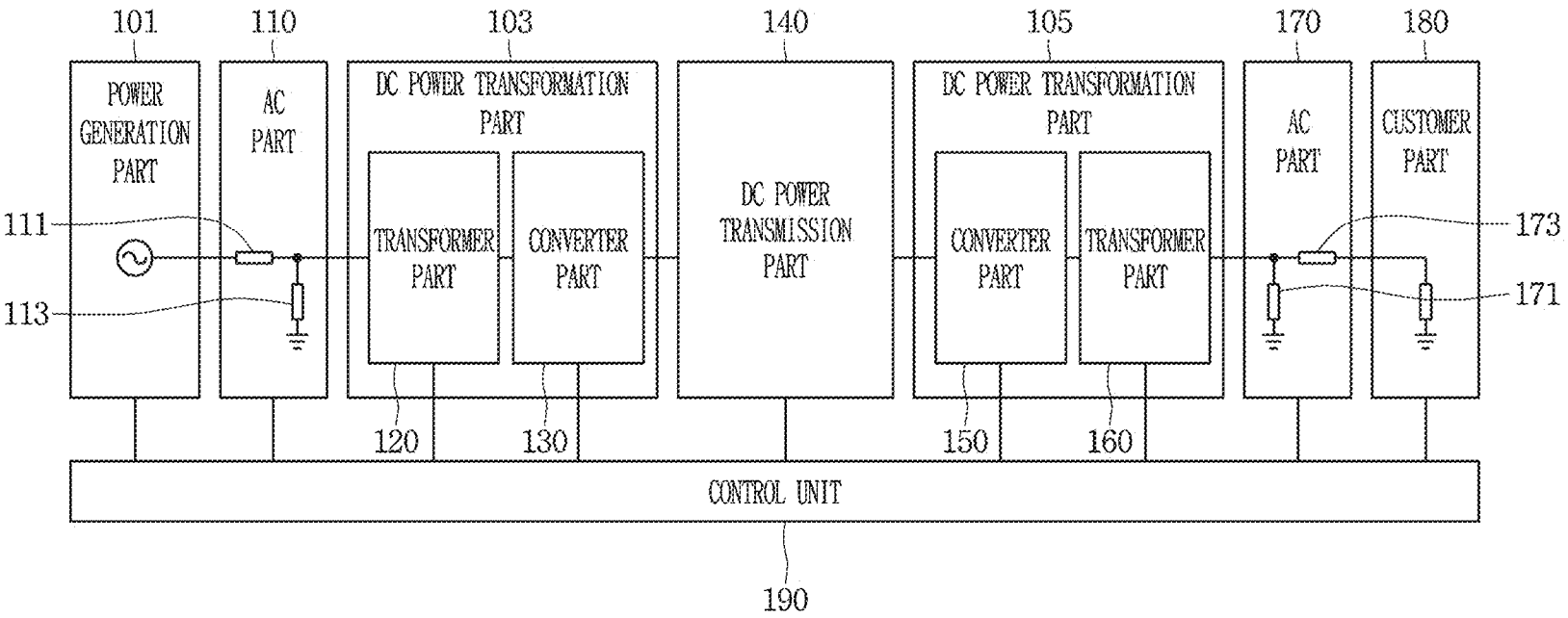
FIG. 1 is a view illustrating the configuration of a high voltage direct current (HVDC) transmission system according to an embodiment of the present disclosure.

In the description of the embodiments, it will be understood that, when a layer (or film), a region, a pattern, or a structure is referred to as being "on" or "under" another substrate, another layer (or film), another region, another pad, or another pattern, it can be "directly" or "indirectly" on the other substrate, layer (or film), region, pad, or pattern, or one or more intervening layers may also be present. Further, such a position of the layer has been described with reference to the drawings The thickness and size of each layer shown in the drawings may be exaggerated, omitted or schematically drawn for the purpose of convenience or clarity. In addition, the size of elements does not utterly reflect an actual size.

Hereinafter, a bypass switch for high voltage direct current transmission according to embodiments will be described in more detail with reference to the accompanying drawings.

FIG. 1 illustrates a high voltage direct current (HVDC) transmission system according to an embodiment.

As illustrated in FIG. 1, an HVDC system 100 according to an embodiment of the present disclosure includes a power generation part 101, a transmission side alternating current (AC) part 110, a transmission side DC power transformation part 103, a direct current (DC) power transmission part 140, a customer side power transformation part 105, a customer side AC part 170, a customer part 180, and a control part 190. The transmission side DC power transformation part 103 includes a transmission side transformer part 120, and a transmission side AC-DC converter part 130. The customer side power transformation part 105 includes a customer side DC-AC converter part 150, and a customer side transformer part 160.

The power generation part 101 generates three-phase AC power. The power generation part 101 may include a plurality of power generating plants.

The transmission side AC part 110 transmits the three-phase AC power generated by the power generation part 101 to a DC power transformation substation including the transmission side transformer part 120 and the transmission side AC-DC converter part 130.

The transmission side transformer part 120 isolates the transmission side AC part 110 from the transmission side AC-DC converter part 130 and the DC power transmission part 140.

The transmission side AC-DC converter part 130 converts the three-phase AC power, corresponding to the output of the transmission side transformer part 120, to DC power.

The DC power transmission part 140 transfers the transmission side DC power to the customer side.

The customer side DC-AC converter part 150 converts the DC power transferred by the DC power transmission part 140 into three-phase AC power.

The customer side transformer part 160 isolates the customer side AC part 170 from the customer side DC-AC converter part 150 and the DC power transmission part 140.

The customer side AC part 170 provides the customer part 180 with three-phase AC power corresponding to the output of the customer side transformer part 160.

The control part 190 controls at least one of the power generation part 101, the transmission side AC part 110, the transmission side DC power transformation part 103, the DC power transmission part 140, the customer side DC power transformation part 105, the customer side AC part 170, the customer part 180, the transmission side AC-DC converter part 130, and the customer side DC-AC converter part 150. Particularly, the control part 190 may control the turn-on and turn-off timings of a plurality of valves which are provided in the transmission side AC-DC converter part 130 and the customer side DC-AC converter part 150. Here, the valves may be thyristors or insulated gate bipolar transistors (IGBT).

Figure 2:
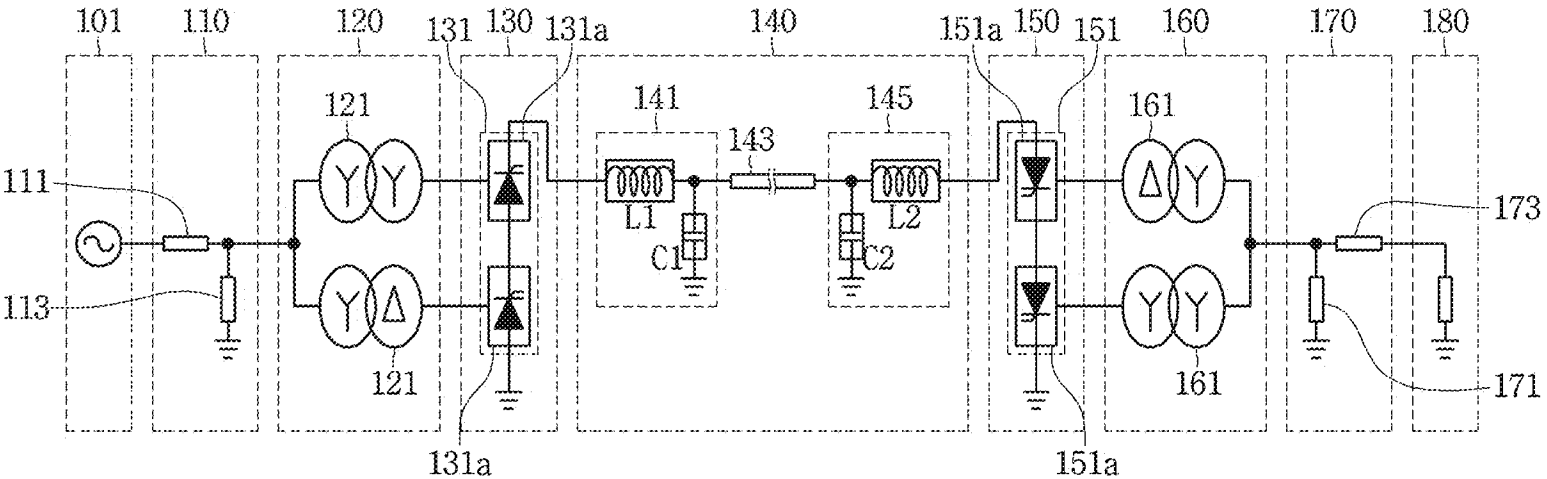
FIG. 2 is a view illustrating the configuration of a monopolar type high voltage direct current (HVDC) transmission system according to an embodiment of the present disclosure.

FIG. 2 illustrates a monopolar type HVDC transmission according to an embodiment.

Particularly, FIG. 2 illustrates a system which transmits DC power with a single pole. Hereinafter, the single pole is described assuming a positive pole, but is not necessarily limited thereto.

The transmission side AC part 110 includes an AC transmission line 111 and an AC filter 113.

The AC power transmission line 111 transfers the three-phase AC power generated by the generation part 101 to the transmission side DC power transformation part 103.

The AC filter 113 removes frequency components other than the frequency component used by the DC power transformation part 103 from the transferred three-phase AC power.

The transmission side transformer part 120 includes one or more transformers 121 for the positive pole. For the positive pole, the transmission side AC-DC converter part 130 includes an AC-positive pole DC converter 131, and the AC-positive pole DC converter 131 includes one or more three-phase valve bridges 131*a* respectively corresponding to the one or more transformers 121.

When one three-phase valve bridge 131*a* is used, the AC-positive pole DC converter 131 may generate positive pole DC power having six pulses by using the AC power. Here, a primary coil and a secondary coil of one of the transformers 121 may have a Y-Y connection or a Y-delta (Δ) connection.

When two three-phase valve bridges 131*a* are used, the AC-positive pole DC converter 131 may generate positive pole DC power having 12 pulses by using the AC power. Here, a primary coil and a secondary coil of one of the two transformers 121 may have a Y-Y connection, and a primary coil and a secondary coil of the other of the two transformers 121 may have a Y-Δ connection.

When three three-phase valve bridges 131*a* are used, the AC-positive pole DC converter 131 may generate positive pole DC power having 18 pulses by using the AC power. The greater the number of pulses of the positive pole DC power, the lower the price of the filter may become.

The DC power transmission part 140 includes a transmission side positive pole DC filter 141, a positive pole DC power transmission line 143, and a customer side positive pole DC filter 145.

The transmission side positive pole DC filter 141 includes an inductor L1 and a capacitor C1 and performs DC filtering on the positive pole DC power output by the AC-positive pole DC converter 131.

The positive pole DC power transmission line 143 has a single DC line for the transmission of the positive pole DC power, and the ground may be used as a current feedback path. One or more switches may be disposed on the DC line.

The customer side positive pole DC filter 145 includes an inductor L2 and a capacitor C2 and performs DC filtering on the positive pole DC power transferred through the positive pole DC power transmission line 143.

The customer side DC-AC converter part 150 includes a positive pole DC-AC converter 151 and the positive pole DC-AC converter 151 includes one or more three-phase valve bridges 151*a*.

The customer side transformer part 160 includes, for the positive pole, one or more transformers 161 respectively corresponding to one or more three-phase valve bridges 151*a*.

When one three-phase valve bridge 151*a* is used, the positive pole DC-AC converter 151 may generate AC power having six pulses by using the positive pole DC power. Here, a primary coil and a secondary coil of one of the transformers 161 may have a Y-Y connection or a Y-delta (Δ) connection.

When two three-phase valve bridges 151*a* are used, the positive pole DC-AC converter 151 may generate AC power having 12 pulses by using the positive pole DC power. Here, a primary coil and a secondary coil of one of the two transformers 161 may have a Y-Y connection, and a primary coil and a secondary coil of the other of the two transformers 161 may have a Y-Δ connection.

When three three-phase valve bridges 151*a* are used, the positive pole DC-AC converter 151 may generate AC power having 18 pulses by using the positive pole DC power. The more the number of pulses of the AC power, the lower the price of the filter may become.

The customer side AC part 170 includes an AC filter 171 and an AC power transmission line 173.

The AC filter 171 removes frequency components other than the frequency component (for example, 60 Hz) used by the customer part 180 from the AC power generated by the customer side power transformation part 105.

The AC power transmission line 173 transfers the filtered AC power to the customer part 180.

Figure 3:
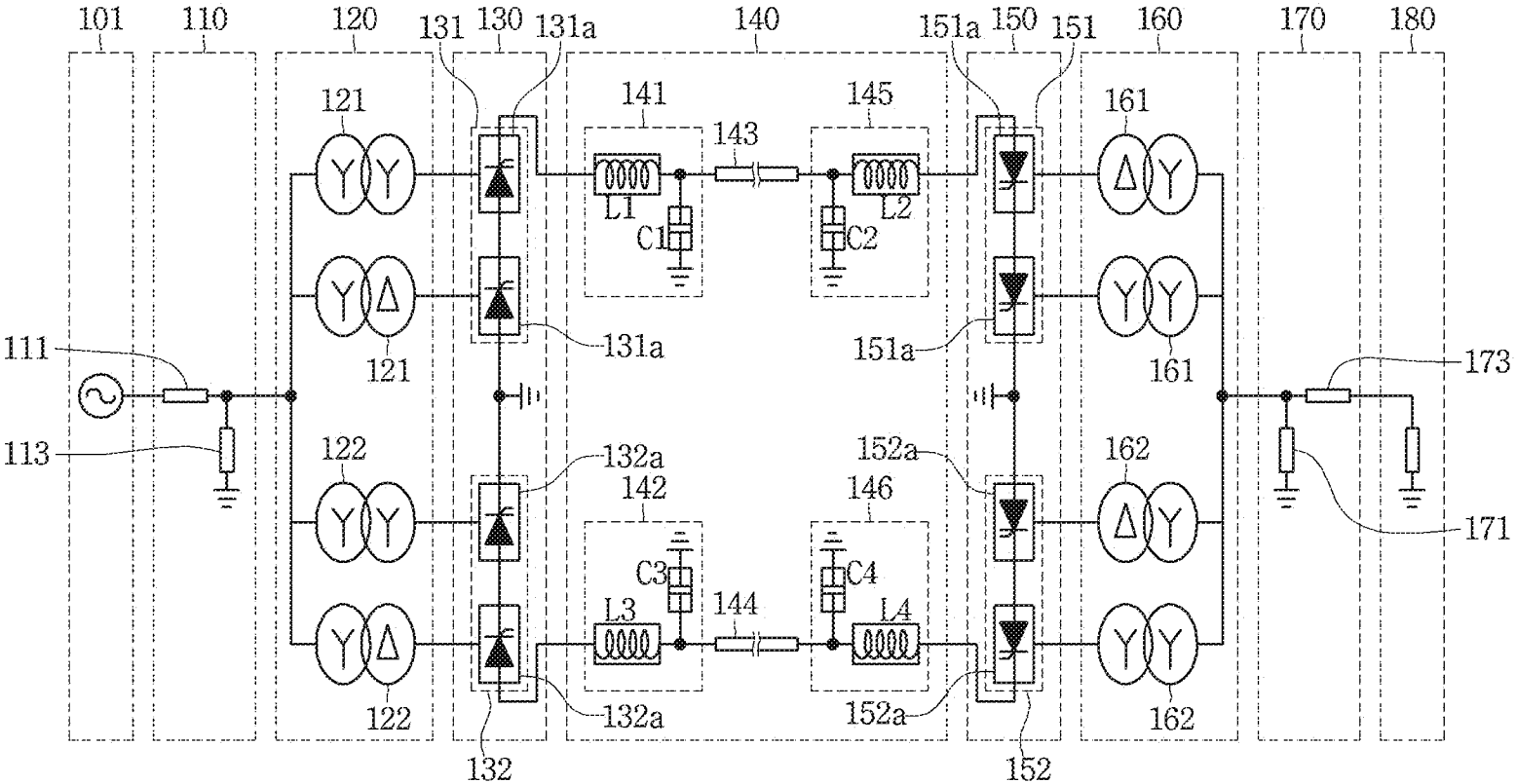
FIG. 3 is a view illustrating the configuration of a bipolar type high voltage direct current (HVDC) transmission system according to an embodiment of the present disclosure.

FIG. 3 illustrates a bipolar type HVDC transmission system according to an embodiment.

Particularly, FIG. 3 illustrates a system which transmits DC power with two poles. In the description below, the two poles are assumed to be a positive pole and a negative pole, but are not necessarily limited thereto.

The transmission side AC part 110 includes an AC transmission line 111 and an AC filter 113.

The AC power transmission line 111 transfers the three-phase AC power generated by the generation part 101 to the transmission side power transformation part 103.

The AC filter 113 removes frequency components other than the frequency component used by the power transformation part 103 from the transferred three-phase AC power.

The transmission side transformer part 120 includes one or more transformers 121 for the positive pole, and one or more transformers 122 for the negative pole. The transmission side AC-DC converter part 130 includes an AC-positive pole DC converter 131 which generates positive pole DC power and an AC-negative pole DC converter 132 which generates negative pole DC power. The AC-positive pole DC converter 131 includes one or more three-phase valve bridges 131*a* respectively corresponding to the one or more transformers 121 for the positive pole. The AC-negative pole DC converter 132 includes one or more three-phase valve bridges 132*a* respectively corresponding to the one or more transformers 122 for the negative pole.

When one three-phase valve bridge 131*a* is used for the positive pole, the AC-positive pole DC converter 131 may generate positive pole DC power having six pulses by using the AC power. Here, a primary coil and a secondary coil of one of the transformers 121 may have a Y-Y connection or a Y-delta (Δ) connection.

When two three-phase valve bridges 131*a* are used for the positive pole, the AC-positive pole DC converter 131 may generate positive pole DC power having 12 pulses by using the AC power. Here, a primary coil and a secondary coil of one of the two transformers 121 may have a Y-Y connection, and a primary coil and a secondary coil of the other of the two transformers 121 may have a Y-Δ connection.

When three three-phase valve bridges 131*a* are used for the positive pole, the AC-positive pole DC converter 131 may generate positive pole DC power having 18 pulses by using the AC power. The more the number of pulses of the positive pole DC power, the lower the price of the filter may become.

When one three-phase valve bridge 132*a* is used for the negative pole, the AC-negative pole DC converter 132 may generate negative pole DC power having six pulses. Here, a primary coil and a secondary coil of one of the transformers 122 may have a Y-Y connection or a Y-delta (Δ) connection.

When two three-phase valve bridges 132*a* are used for the negative pole, the AC-negative pole DC converter 132 may generate negative pole DC power having 12 pulses. Here, a primary coil and a secondary coil of one of the two transformers 122 may have a Y-Y connection, and a primary coil and a secondary coil of the other of the two transformers 122 may have a Y-Δ connection.

When three three-phase valve bridges 132*a* are used for the negative pole, the AC-negative pole DC converter 132 may generate negative pole DC power having 18 pulses. The more the number of pulses of the negative pole DC power, the lower the price of the filter may become.

The DC power transmission part 140 includes a transmission side positive pole DC filter 141, a transmission side negative pole DC filter 142, a positive pole DC power transmission line 143, a negative pole DC power transmission line 144, a customer side positive pole DC filter 145, and a customer side negative pole DC filter 146.

The transmission side positive pole DC filter 141 includes an inductor L1 and a capacitor C1 and performs DC filtering on the positive pole DC power output by the AC-positive pole DC converter 131.

The transmission side negative pole DC filter 142 includes an inductor L3 and a capacitor C3 and performs DC filtering on the negative pole DC power output by the AC-negative pole DC converter 132.

The positive pole DC power transmission line 143 has a single DC line for transmission of the positive pole DC power, and the earth may be used as a current feedback path. One or more switches may be disposed on the DC line.

The negative pole DC power transmission line 144 has a single DC line for the transmission of the negative pole DC power, and the earth may be used as a current feedback path. One or more switches may be disposed on the DC line.

The customer side positive pole DC filter 145 includes an inductor L2 and a capacitor C2 and performs DC filtering on the positive pole DC power transferred through the positive pole DC power transmission line 143.

The customer side negative pole DC filter 146 includes an inductor L4 and a capacitor C4 and performs DC filtering of the negative pole DC power transferred through the negative pole DC power transmission line 144.

The customer side DC-AC converter part 150 includes a positive pole DC-AC converter 151 and a negative pole DC-AC converter 152. The positive pole DC-AC converter 151 includes one or more three-phase valve bridges 151*a*, and the negative pole DC-AC converter 152 includes one or more three-phase valve bridges 152*a*.

The customer side transformer part 160 includes, for the positive pole, one or more transformers 161 respectively corresponding to one or more three phase valve bridges 151*a*, and for the negative pole, one or more transformers 162 respectively corresponding to one or more three-phase valve bridges 152*a*.

When one three-phase valve bridge 151*a* is used for the positive pole, the positive pole DC-AC converter 151 may generate AC power having six pulses by using the positive pole DC power. Here, a primary coil and a secondary coil of one of the transformers 161 may have a Y-Y connection or a Y-delta (Δ) connection.

When two three-phase valve bridges 151*a* are used for the positive pole, the positive pole DC-AC converter 151 may generate AC power having 12 pulses by using the positive pole DC power. Here, a primary coil and a secondary coil of one of the two transformers 161 may have a Y-Y connection, and a primary coil and a secondary coil of the other of the two transformers 161 may have a Y-Δ connection.

When three three-phase valve bridges 151*a* are used for the positive pole, the positive pole DC-AC converter 151 may generate AC power having 18 pulses by using the positive pole DC power. The more the number of pulses of the AC power, the lower the price of the filter may become.

When one three-phase valve bridge 152*a* is used for the negative pole, the negative pole DC-AC converter 152 may generate AC power having six pulses by using the negative pole DC power. Here, a primary coil and a secondary coil of one of the transformers 162 may have a Y-Y connection or a Y-delta (Δ) connection.

When two three-phase valve bridges 152*a* are used for the negative pole, the negative pole DC-AC converter 152 may generate AC power having 12 pulses by using the negative pole DC power. Here, a primary coil and a secondary coil of one of the two transformers 162 may have a Y-Y connection, and a primary coil and a secondary coil of the other of the two transformers 162 may have a Y-Δ connection.

When three three-phase valve bridges 152*a* are used for the negative pole, the negative pole DC-AC converter 152 may generate AC power having 18 pulses by using the negative pole DC power. The more the number of pulses of the AC power, the lower the price of the filter may become.

The customer side AC part 170 includes an AC filter 171 and an AC power transmission line 173.

The AC filter 171 removes frequency components other than the frequency component (for example, 60 Hz) used by the customer part 180 from the AC power generated by the customer side DC power transformation part 105.

The AC power transmission line 173 transfers the filtered AC power to the customer part 180.

Figure 4:
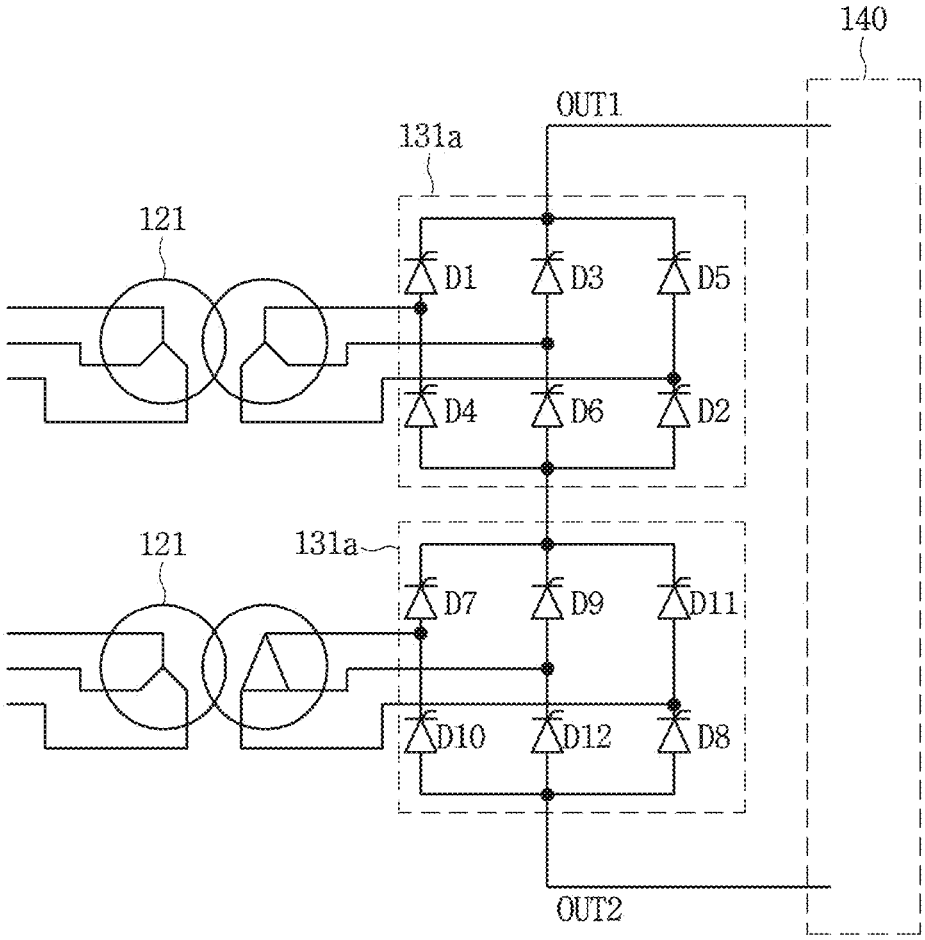
FIG. 4 is a view illustrating a wiring of a transformer and a three phase valve bridge according to an embodiment of the present disclosure.

FIG. 4 illustrates a connection between a transformer and a three-phase valve bridge according to an embodiment.

Particularly, FIG. 4 illustrates the connection between the two transformers 121 for the positive pole and the two three-phase valve bridges 131*a* for the positive pole. Since the connection between the two transformers 122 for the negative pole and the two three-phase valve bridges 132*a* for the negative pole, the connection between the two transformers 161 for the positive pole and the two three-phase valve bridges 151*a* for the positive pole, the connection between the two transformers 162 for the negative pole and the two three-phase valve bridges 152*a* for the negative pole, the connection between the one transformer 121 for the positive pole and the one three-phase valve bridge 131*a* for the positive pole, the connection between the one transformer 161 for the positive pole and the one three-phase valve bridge 151*a* for the positive pole, etc., could be easily derived from the embodiment of FIG. 4, drawings and descriptions thereof will not be provided herein.

In FIG. 4, the transformer 121 having the Y-Y connection is referred to as an upper transformer, the transformer 121 having the Y-Δ connection is referred to as a lower transformer, the three-phase valve bridge 131*a* connected to the upper transformer is referred to as an upper three phase valve bridge, and the three-phase valve bridges 131*a* connected to the lower transformer is referred to as a lower three-phase valve bridge.

The upper three-phase valve bridge and the lower three-phase valve bridge have two output terminals outputting DC power, i.e., a first output terminal OUT1 and a second output terminal OUT2.

The upper three-phase valve bridge includes six valves D1 to D6, and the lower three-phase valve bridge includes six valves D7 to D12.

The valve D1 has a cathode connected to the first output terminal OUT1 and an anode connected to a first terminal of the secondary coil of the upper transformer.

The valve D2 has a cathode connected to the anode of the valve D5 and an anode connected to the anode of the valve D6.

The valve D3 has a cathode connected to the first output terminal OUT1 and an anode connected to a second terminal of the secondary coil of the upper transformer.

The valve D4 has a cathode connected to the anode of the valve D1 and an anode connected to the anode of the valve D6.

The valve D5 has a cathode connected to the first output terminal OUT1 and an anode connected to a third terminal of the secondary coil of the upper transformer.

The valve D6 has a cathode connected to the anode of the valve D3.

The valve D7 has a cathode connected to the anode of the valve D6 and an anode connected to a first terminal of the secondary coil of the lower transformer.

The valve D8 has a cathode connected to the anode of the valve D11 and an anode connected to a second output terminal OUT2.

The valve D9 has a cathode connected to the anode of the valve D6 and an anode connected to a second terminal of the secondary coil of the lower transformer.

The valve D10 has a cathode connected to the anode of the valve D7 and an anode connected to the second output terminal OUT2.

The valve D11 has a cathode connected to the anode of the valve D6 and an anode connected to a third terminal of the secondary coil of the lower transformer.

The valve D12 has a cathode connected to the anode of the valve D9 and an anode connected to the second output terminal OUT2.

Also, the customer side DC-AC converter part 150 may be configured as a modular multi-level converter 200.

The modular multi-level converter 200 may convert DC power into AC power by using a plurality of sub-modules 210.

Figure 5:
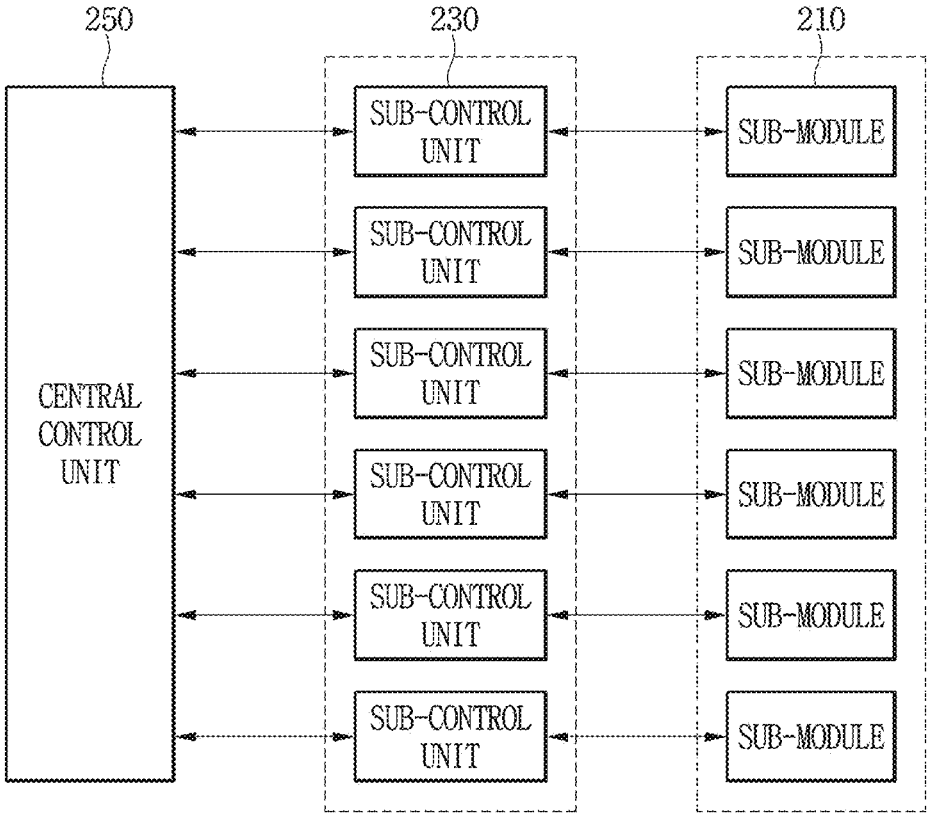
FIG. 5 is a block diagram illustrating a modular multi-level converter according to an embodiment of the present disclosure.
Figure 6:
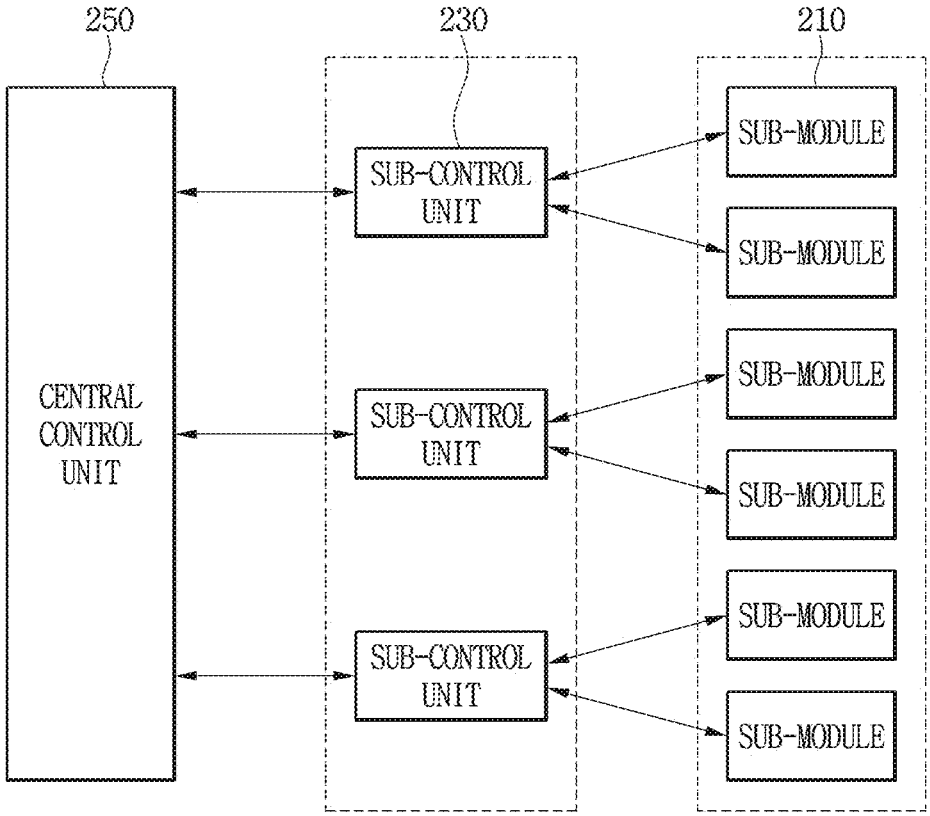
FIG. 6 is a block diagram illustrating a modular multi-level converter according to another embodiment of the present disclosure.

Referring to FIGS. 5 and 6, the configuration of the modular multi-level converter 200 will be described.

FIGS. 5 and 6 are block diagrams illustrating a modular multi-level converter 200.

The modular multi-level converter 200 includes a central control unit 250, a plurality of sub-control units 230 and a plurality of sub-modules 210.

The central control unit 250 controls the plurality of sub-control units 230, and the sub-control units 230 may respectively control the sub-modules 210 connected thereto.

Here, as illustrated in FIG. 5, one sub-control unit 230 is connected to one sub-module 210 and accordingly, may control the switching operation of the one sub-module 210 connected thereto based on a control signal transferred through the central control unit 250.

Also, alternatively, as shown in FIG. 6, one sub-control unit 230 is connected to a plurality of sub-modules 210 and accordingly, may confirm each of the control signals for the plurality of sub-modules 210 connected thereto by using a plurality of control signals transferred through the central control unit 250. Each of the plurality of sub-modules 210 may be controlled based on the confirmed control signals.

Figure 7:
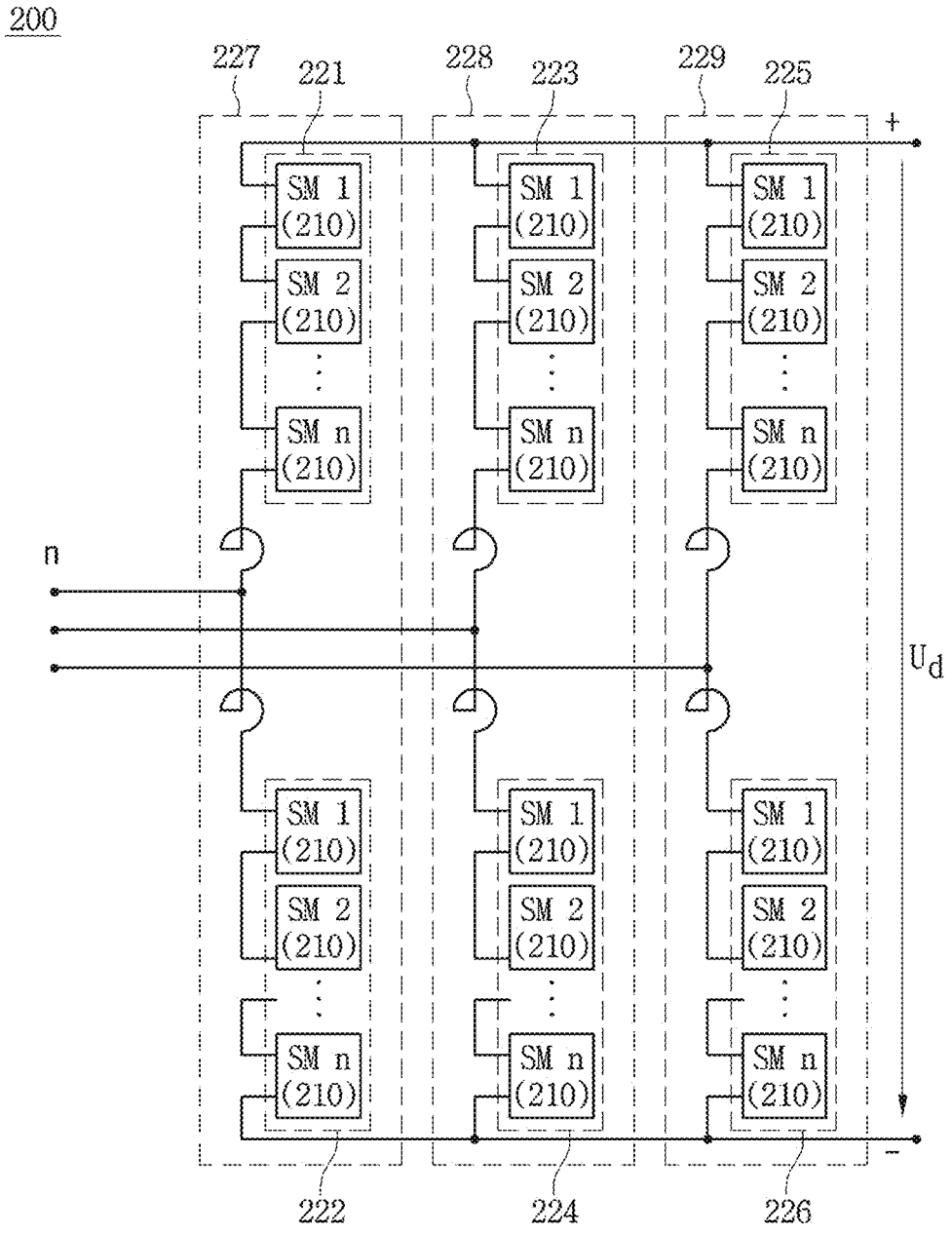
FIG. 7 illustrates connections of the plurality of sub-modules according to an embodiment of the present disclosure.

Referring to FIG. 7, the connections of the plurality of sub-modules 210 included in the modular multi-level converter 200 will be described.

FIG. 7 illustrates the connections of the plurality of sub-modules 210 included in the modular multi-level converter 200.

Referring to FIG. 7, the plurality of sub-modules 210 may be serially connected, and the plurality of sub-modules 210 connected to a positive pole or negative pole of one phase may constitute one arm.

The three-phase modular multi-level converter 200 may normally include six arms, and include a positive pole and a negative pole for each of the three phases A, B, and C to form the six arms.

Accordingly, the three-phase modular multi-level converter 200 may include: a first arm 221 including a plurality of sub-modules 210 for a positive pole of phase A; a second arm 222 including a plurality of sub-modules 210 for a negative pole of phase A; a third arm 223 including a plurality of sub-modules 210 for a positive pole of phase B; a fourth arm 224 including a plurality of sub-modules 210 for a negative pole of phase B; a fifth arm 225 including a plurality of sub-modules 210 for a positive pole of phase C; and a sixth arm 226 including a plurality of sub-modules 210 for a negative pole of phase C.

Also, the plurality of sub-modules 210 for one phase may constitute a leg.

Accordingly, the three-phase modular multi-level converter 200 may include: a phase A leg 227 including a plurality of sub-modules 210 for phase A; a phase B leg 228 including a plurality of sub-modules 210 for phase B; and a phase C leg 229 including a plurality of sub-modules 210 for phase C.

Therefore, the first to sixth arms 221 to 226 are respectively included in the phase A leg 227, the phase B leg 228, and phase C leg 229.

Specifically, in the phase A leg 227, the first arm 221, which is the positive pole arm of phase A, and the second arm 222, which is the negative pole arm of phase A, are included; and in the phase B leg 228, the third arm 223, which is the positive pole arm of phase B, and the fourth arm 224, which is the negative pole arm of phase B, are included. Also, in the phase C leg 229, the fifth arm 225, which is the positive pole arm of phase C, and the sixth arm 226, which is the negative pole arm of phase C, are included.

Also, the plurality of sub-modules 210 may constitute a positive pole arm 227 and a negative pole arm 228 according to polarity.

Specifically, referring to FIG. 7, the plurality of sub-modules 210 included in the modular multi-level converter 200 may be classified, with respect to a neutral line n, into a plurality of sub-modules 210 corresponding to the positive pole and a plurality of sub-modules 210 corresponding to the negative pole.

Thus, the modular multi-level converter 200 may include a positive arm 227 including the plurality of sub-modules 210 corresponding to the positive pole, and a negative arm 228 including the plurality of sub-modules 210 corresponding to the negative pole.

Accordingly, the positive pole arm 227 may include the first arm 221, the third arm 223, and the fifth arm 225; and the negative pole arm 228 may include the second arm 222, the fourth arm 224, and the sixth arm 226.

Next, referring to FIG. 8, the configuration of the sub-module 210 will be described.

Figure 8:
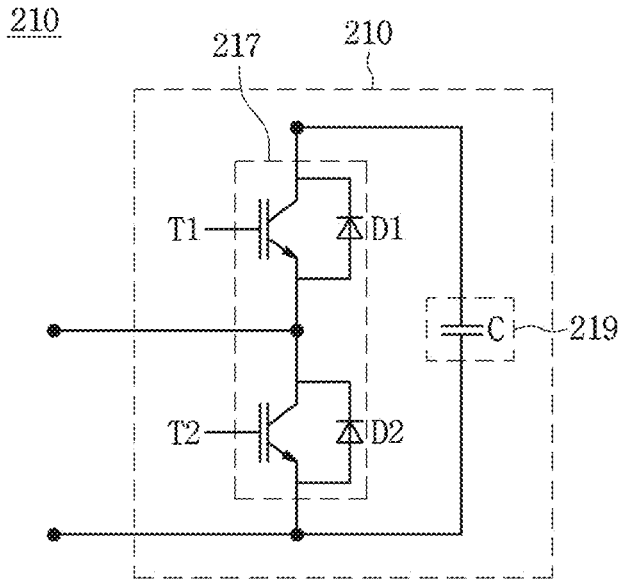
FIG. 8 is an exemplary view illustrating a configuration of a sub-module according to an embodiment of the present disclosure.

FIG. 8 is an exemplary view illustrating a configuration of the sub-module 210.

Referring to FIG. 8, the sub-module 210 includes two switches, two diodes, and a capacitor. Such a shape of the sub-module 210 is also referred to as a half-bridge shape or a half bridge inverter.

In addition, the switch included in a switching part 217 may include a power semiconductor.

Here, the power semiconductor refers to a semiconductor element for a power apparatus, and may be optimized for the conversion or control of electric power. Also, the power semiconductor is referred to as a valve unit.

Accordingly, the switch included in the switching part 217 may include a power semiconductor and may include, for example, an insulated gate bipolar transistor (IGBT), a gate turn-off thyristor (GTO), an integrated gate commutated thyristor (IGCT), etc.

The storage part 219 includes the capacitor, and thus may charge or discharge energy. The sub-module 210 may be represented as an equivalent model based on the configuration and the operation of the sub-module 210.

Figure 9:
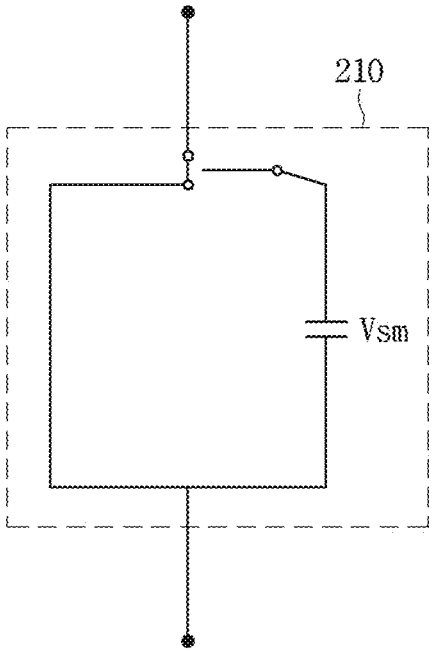
FIG. 9 illustrates an equivalent model of a sub-module according to an embodiment of the present disclosure.

FIG. 9 illustrates an equivalent model of the sub-module 210, and referring to FIG. 9, the sub-module 210 may be illustrated as an energy charge and discharge unit including a switch and a capacitor.

Accordingly, it may be turned out that the sub-module 210 is the same as an energy charge and discharge unit having an output voltage of Vsm.

Figure 10:
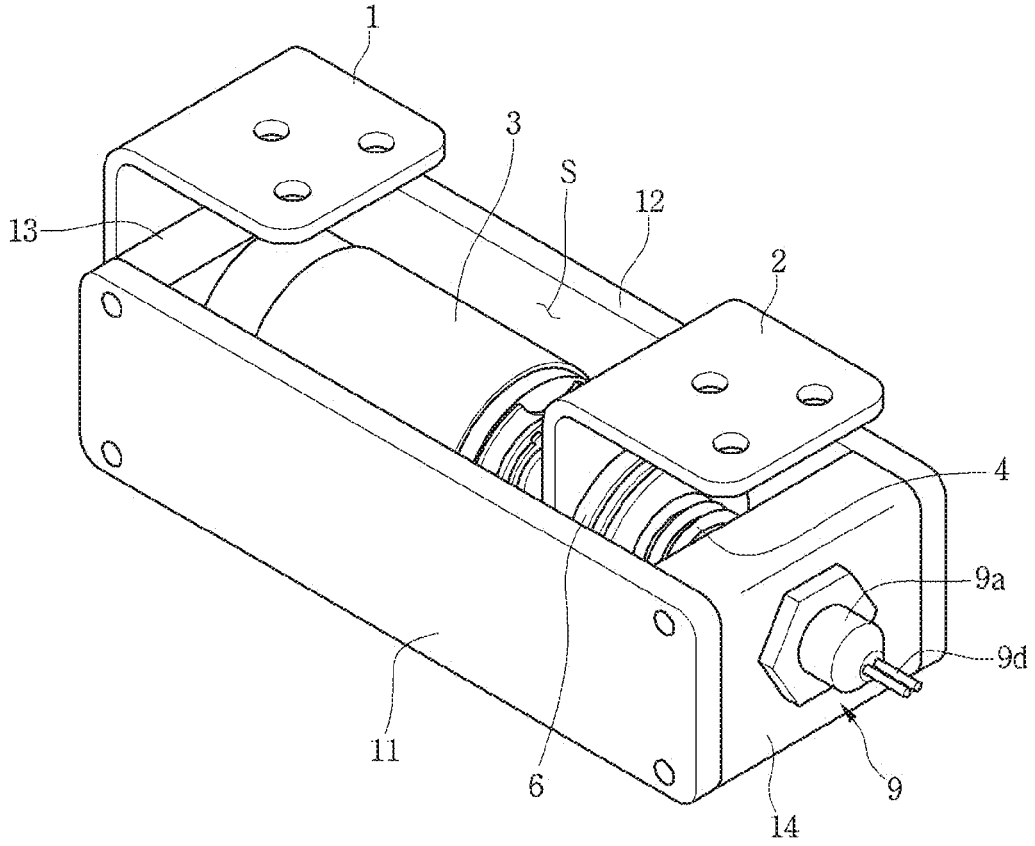
FIG. 10 is a perspective view of a bypass switch for HVDC transmission according to an embodiment.
Figure 11:
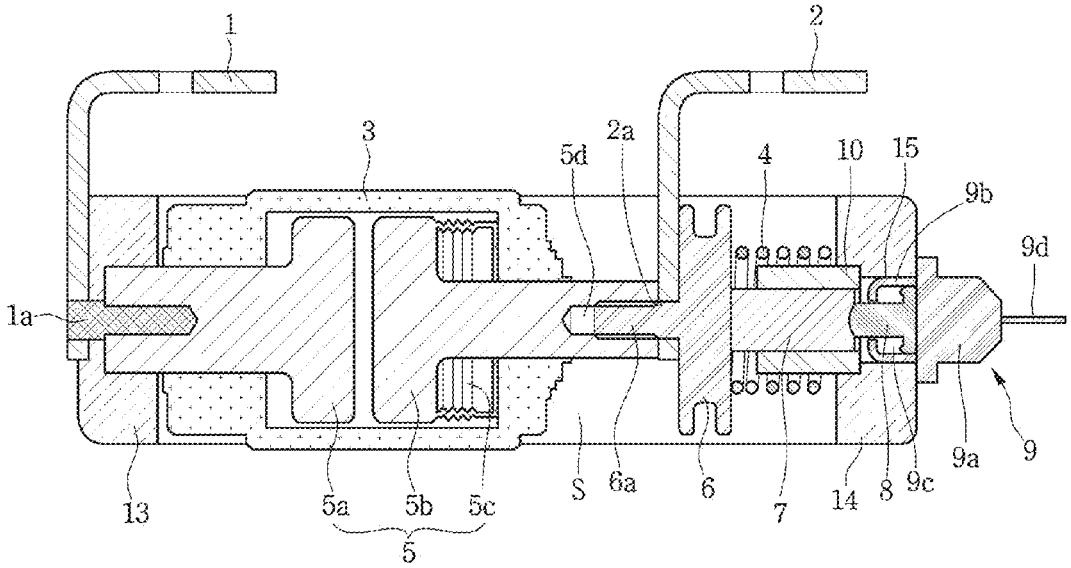
FIG. 11 is a cross-sectional view of a bypass switch for HVDC transmission according to an embodiment when a fixed contactor and a movable contactor are spaced apart.
Figure 12:
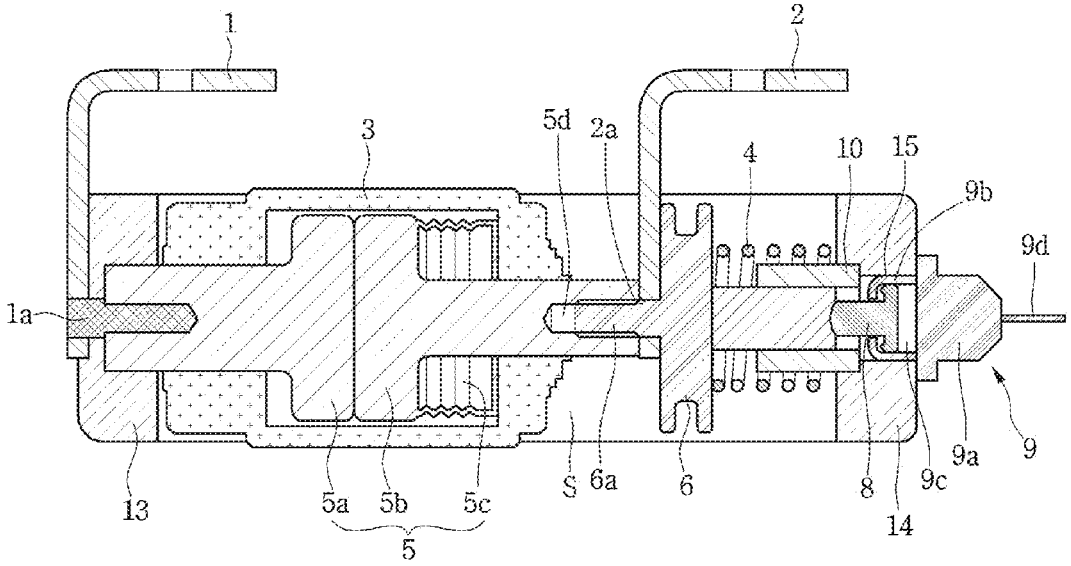
FIG. 12 is a cross-sectional view of a bypass switch for HVDC transmission according to an embodiment when the fixed contactor and the movable contactor are contacted.

FIG. 10 is a perspective view of a bypass switch for HVDC transmission according to an embodiment, and FIG. 11 is a cross-sectional view of a bypass switch for HVDC transmission according to an embodiment when a fixed contactor and a movable contactor are spaced apart. FIG. 12 is a cross-sectional view of a bypass switch for HVDC transmission according to an embodiment when the fixed contactor and the movable contactor are contacted.

Referring to FIGS. 10 and 11, when a failure of a sub-module 210 is detected, a bypass switch for HVDC transmission according to an embodiment prevents the effects of the failure from being propagated to other adjacent sub-modules 210 by shorting the sub-module 210 at which the failure is detected.

That is, a bypass switch for HVDC transmission maintains an opened state while sub-modules 210 normally operate, and when a failure is detected at a sub-module 210, shorts the sub-module 210 at which the failure occurs.

The bypass switch for HVDC transmission according to an embodiment includes a housing 3, a fixed contactor 5*a* disposed in the housing, and a moving contactor 5*b*.

The housing 3 may have a space defined therein, and the fixed contactor 5*a* and the movable contactor 5*b* may make contact or break contact in the space of the housing 3. The space of the housing 3 may be defined such that the movable contact 5 may be moved.

The housing 3 may also be formed as a vacuum housing. The housing may be a guide which guides the movement of the movable contactor 5*b*.

In the housing 3 of the bypass switch for HVDC transmission, a bellows 5*c* disposed between the movable contactor 5*b* and the housing 3 may be further included. In the housing 3, the bellows 5*c* may be disposed between the movable contactor 5*b* and the housing 3 such that a vacuum state may be maintained between the fixed contactor 5*a* and the movable contactor 5*b*.

The housing 3 may be formed of an insulative material, and a vacuum interrupter 5 including the fixed contactor 5*a*, the movable contactor 5*b*, and the bellows 5*c* may be disposed therein.

The fixed contactor 5*a* may be disposed so as to be fixed at the housing 3. The fixed contactor 5*a* may be disposed at one side in the housing 3. The fixed contactor 5*a* may be electrically connected to a first portion (not shown) of an HVDC transmission circuit.

The fixed contactor 5*a* may include an inner plate disposed inside the housing 3, and an outer connection part which protrudes from the inner plate and is exposed to the outside of the housing 3. A coupling member 1*a*, which electrically connects a first bussbar 1 described below to the fixed contactor 5*a*, may be connected to the outer connection part of the fixed contactor 5*a*.

The movable contactor 5*b* may be disposed so as to be movable at the housing 3. The movable contactor 5*b* may be disposed at the other side in the housing 3. The movable contactor 5*b* may be disposed in the housing 3 so as to face the fixed contactor 5*a*. The movable contactor 5*b* may be installed to be movable to a position contacting the fixed contactor 5*a* and movable to a position spaced apart from the fixed contactor 5*a*. The movable contactor 5*b* may be electrically connected to a second portion of an HVDC transmission circuit.

The movable contactor 5*b* may include an inner plate disposed inside the housing 3, and an outer connection part which protrudes from the inner plate and is exposed to the outside of the housing 3. An insulation member 6 described below may be connected to the outer connection part of the movable contactor 5*b*.

The fixed contactor 5*a* may be electrically connected to an end of a sub-module circuit, the movable contactor 5*b* may be electrically connected to the other end of the sub-module circuit, and the sub-module circuit may assume an electrically shorted state when the fixed contactor 5*a* and the movable contactor 5*b* contact each other. In this case, when a problem such as a failure of the sub-module circuit occurs, propagation to other circuits or other electrical components may be prevented.

The bypass switch for HVDC transmission may include an insulation member 6 coupled to the movable contactor 5*b*. The insulation member 6 may be coupled to one side of the movable contactor 5*b*. The insulation member 6 may be integrally moved with the movable contactor 5*b*, and when the insulation member 6 is moved, the movable contactor 5*b* may be moved by the insulation member 6.

The bypass switch for HVDC transmission may include an explosive actuator 9 which is exploded according to an electrical signal. The explosive actuator 9 may be a driving source which generates driving force allowing the movable contactor 5*b* to be moved toward the fixed contactor 5*a*. The explosive actuator 9 may put the movable contactor 5*b* and the fixed contactor 5*a* in contact with each other by moving the insulation member 6.

The bypass switch for HVDC transmission may include a piston mechanism 7 and 8 which applies force to move the insulation member 6 by being moved by the force of gas generated as the explosive actuator 9 explodes. The piston mechanism 7 and 8 transfers the force of the gas generated when the explosive actuator 9 explodes, and may allow the fixed contactor 5*a* and the movable contactor 5*b* to be electrically connected. That is, the piston mechanism 7 and 8 may be at least one power transfer member which transfers the driving force of the explosive actuator 9 to the insulation member 6.

The bypass switch for HVDC transmission may be sequentially disposed in the direction of force transfer in the sequence of the piston mechanism 7 and 8, the insulation member 6, and the movable contactor 5*b*. The insulation member 6 may be disposed between the movable contactor 5*b* and the piston mechanism 7 and 8. Also, the piston mechanism 7 and 8 may be disposed between the insulation member 6 and the explosive actuator 9.

The piston mechanism 7 and 8 includes a piston member 8 movably disposed so as to be moved by the gas generated from the explosive actuator 9 and connected to the insulation member 6. In this case, when the explosive actuator 9 explodes, the piston member 8 may directly move the insulation member 6.

The piston mechanism 7 and 8 may include a piston member 8 moved by the gas generated from the explosive actuator 9, and a magnetic member 7 transferring the force applied by the piston member 8 between the piston member 8 and the insulation member 6 to the insulation member 6.

The explosive actuator 9 may include an inflator 9*a* injecting gas, and an inflator cover 9*b* coupled to the inflator 9*a*. The inflator cover 9*b* may include an inner space 9*c* defined therein in which the gas injected from the inflator 9*a* flows to the piston member 8 and the piston member 8 may move.

The inflator 9*a* may be turned on when a failure is detected at a sub-module 210, and may inject high-pressure gas into the inner space 9*c* of the inflator cover 9*b*.

The inflator cover 9*b* may be an inflator housing in which the piston member 8 may be movably accommodated and the high-pressure gas is expanded. A portion of the piston member 8 may be positioned inside the explosive actuator 9. The piston member 8 may be moved in the inner space 9*c*. The piston member 8 may be pushed by the gas ejected from the explosive actuator 9 when the explosive actuator 9 explodes, and may push the magnetic member 7 in a direction toward the insulation member 6.

The magnetic member 7 may be disposed between the piston member 8 and the insulation member 6. In this case, when the explosive actuator 9 explodes, the piston member 8 may move the magnetic member 7, and the magnetic member 7 may move the insulation member 6. The magnetic member 7 may be connected to at least one of the piston member 8 and the insulation member 6, and when the piston member 8 is moved toward the insulation member 6, the magnetic member 7 is moved toward the insulation member 6 together with the piston member 8 and may move and slide the insulation member 6.

The bypass switch for HVDC transmission may further include a magnet 10 which holds the magnetic member 7 such that the movable contactor 5*b* is spaced apart from the fixed contactor 5*a* before the operation of the explosive actuator 9. The magnet 10 may be installed at a frame 11, 12, 13, and 14 described below, and may apply magnetic force to the magnetic member 7 when installed at the frame 11, 12, 13, and 14.

One side of the movable contactor 5*b* may be coupled to the insulation member 6, and the insulation member 6 is coupled to the magnetic member 7. The magnet 10 may pull the magnetic member 7 in a direction in which the movable contactor 5*b* is moved away from the fixed contactor 5*a* before the explosive actuator 9 is operated. In this case, the insulation member 6 may be pulled in a direction toward the explosive actuator 9 by the magnetic member 7.

The magnetic member 7 may be provided in a shape of a circular cylinder or a rod, and the magnet 10 may be provided in a shape of a hollow cylinder such that the magnetic member 7 is disposed therein. The piston member 8 may be coupled to the magnetic member 7. The magnetic member 7 may be coupled to the insulation member 6. The magnetic member 7 may be inserted into the magnet 10. When the explosive actuator 9 operates, the magnetic member 7 is pushed by the piston member 8 and at least a portion thereof may be exposed to the outside of the magnet 10.

The bypass switch for HVDC transmission may further include a spring 4 which applies force to the insulation member 6. The spring 4 may be disposed between the insulation member 6 and the piston member 8, between the insulation member 6 and the explosive actuator 9, or between the insulation member 6 and the frame 11, 12, 13, and 14.

The spring 4 may be disposed so as to be positioned adjacent to the magnet 10. The spring 4 may be positioned at an outer circumferential surface of the magnet 10. The spring 4 may maintain the state of contacting the insulation member 6. The spring 4 may be disposed between the insulation member 6 and the frame 11, 12, 13, and 14 and apply force to the insulation member 6. The spring 4 may apply force in a direction in which the movable contactor 5*b*, the insulation member 6, and the magnetic member 7 are moved toward the fixed contactor 5*a*. The force applied by the spring 4 may be smaller than the force by which the magnet 10 pulls the magnetic member 7. The spring may maintain a compressed state before the explosive actuator 9 operates.

The piston member 8 may push out the magnetic member 7 through the force of explosion gas when the explosive actuator 9 explodes, the insulation member 6 may be pushed by the magnetic member 7, and the movable contactor 5*b* may contact the fixed contactor 5*a*. When the magnetic member 7 is moved in a direction toward the fixed contactor 5*a* in the magnet 10, the spring 4 may maintain an expanded state.

When the magnetic member 7 and the insulation member 6 move as described above, the spring 4 may be released from a compressed state and apply force in a direction from the movable contactor 5*b* toward the fixed contactor 5*a*, and allow the movable contactor 5*b* and the fixed contactor 5*a* to maintain the state of being in contact. That is, the spring 4 may help the magnetic member 7 more quickly move toward the movable contactor 5*b* when the explosive actuator 9 operates, and after the explosive actuator 9 operates, the spring 4 may help the movable contactor 5*b* and the fixed contactor 5*a* not to break contact.

The bypass switch for HVDC transmission may further include the frame 11, 12, 13, and 14. The frame 11, 12, 13, and 14 may include a space S defined therein. The housing 3 may be disposed in the space S. The housing 3 may be accommodated in the space S. The movable contactor 5*b* and the insulation member 6 may be movably positioned in the space S. At least a portion of the spring 4 may be positioned in the space S. At least a portion of the magnet 10 may be positioned in the space S. The frame 11, 12, 13, and 14 may protect the housing 3, the movable contact 5*b*, the insulation member 6, the spring 4, and the magnet 10. The frame 11, 12, 13, and 14 may define an appearance of the bypass switch for HVDC transmission.

The frame 11, 12, 13, and 14 may include a first frame 11 and a second frame 12. The first and second frames 11 and 12 may be disposed parallel to each other along a longitudinal direction of the bypass switch for HVDC transmission.

The frame 11, 12, 13, and 14 may further include third and fourth frames 13 and 14. The third and fourth frames 13 and 14 may be disposed parallel to each other at both ends of the first and second frames 11 and 12. The third and fourth frames 13 and 14 may be coupled to the first and second frames 11 and 12 and supported by the first and second frames 11 and 12. The frame 11, 12, 13, and 14 may define a space S with the first, second, third, and fourth frames.

The fixed contactor 5*a* may be disposed in the frame 11, 12, 13, and 14. Also, the explosive actuator 9 may be disposed in the frame 11, 12, 13, and 14. The frame 11, 12, 13, and 14 may include a through hole 15 into which a portion of the explosive actuator 9 is inserted.

The inflator 9*a* of the explosive actuator 9 may be disposed at the outside of the frame 11, 12, 13, and 14, and a wire 9*d* supplying power to the inflator 9*a* may be connected to the inflator 9*d* at the outside of the frame 11, 12, 13, and 14.

The inflator cover 9*b* of the explosive actuator 9 may be disposed to be positioned at the through hole 15 formed on the frame 11, 12, 13, and 14, and may be protected by the frame 11, 12, 13, and 14.

The fixed contactor 5*a* and the explosive actuator 9 may be disposed at the frame 11, 12, 13, and 14 to face each other. The fixed contactor 5*a* and the explosive actuator 9 may be separately disposed at the first and second frames 11 and 12, or may be separately disposed at the third and fourth frames 13 and 14. Hereinafter, the fixed contactor 5*a* and the explosive actuator 9 will be described as being separately disposed at the third and fourth frames 13 and 14.

Any one of the fixed contactor 5*a* and the explosive actuator 9 may be disposed at the third frame 13 and the other may be disposed at the fourth frame 14 facing the third frame 13.

When the fixed contactor 5*a* is disposed at the third frame 13, the explosive actuator 9 may be disposed at the fourth frame 14, and conversely, when the fixed contactor 5*a* is disposed at the fourth frame 14, the explosive actuator 9 may be disposed at the third frame 13.

The housing 3 may be disposed together with the fixed contactor 5*a* at the frame at which the fixed contactor 5*a* is disposed, from among the first, second, third, and fourth frames.

The magnet 10 may be disposed together with the explosive actuator 9 at the frame at which the explosive actuator 9 is disposed, from among the first, second, third, and fourth frames. The spring 4 may be disposed between the frame at which the explosive actuator 9 is disposed and the insulation member 6.

The fixed contactor 5*a* may be disposed at and supported by the third frame 13, and the housing 3 may be disposed at and supported by the third frame 13. Meanwhile, the explosive actuator 9 may be disposed at and supported by the fourth frame 14, the magnet 10 may be disposed at and supported by the fourth frame 14, and the spring 4 may be disposed between the fourth frame 14 and the insulation member 6.

The bypass switch for HVDC transmission may include a first bussbar 1 connected to the fixed contactor 5*a*, and a second bussbar 2 connected to the movable contactor 5*b*. The first bussbar 1 may be electrically connected to the fixed contactor 5*a*. Also, the second bussbar may be electrically connected to the movable contactor 5*b*. When the fixed contactor 5*a* and the movable contactor 5*b* are in contact with each other, circuits electrically connected to the first and second bussbars 1 and 2 may be shorted.

The fixed contactor 5*a* may be electrically connected to the first portion of the HVDC transmission circuit through the first bussbar 1, and the movable contactor 5*b* may be electrically connected to the first portion of the HVDC transmission circuit through the second bussbar 2.

The first bussbar 1 may be electrically connected to the fixed contactor 5*a* through a coupling member 1*a*, and of course, may be directly and electrically connected to the fixed contactor 5*a*.

The second bussbar 2 may be disposed between the movable contactor 5*b* and the insulation member 6 and may be electrically connected to the movable contactor 5*b*. The insulation member 6 allows the second bussbar 2 and the magnetic member 7 formed of a metallic material to be electrically insulated. The insulation member 6 may include a protrusion 6*a* formed thereon, and the protrusion 6*a* may penetrate a through hole 2*a* formed in the second bussbar 2 and may be inserted into an insertion groove 5*d* formed in the movable contactor 5*b* to be coupled. The spring 4 may be disposed between the second bussbar 2 and the fourth frame 14. The spring 4 may apply force such that the insulation member 6 may move in the direction in which the fixed contactor 5*a* is disposed.

The bypass switch for HVDC transmission, under normal circuit conditions, maintains a state in which the fixed contactor 5*a* and the movable contactor 5*b* are spaced apart from and electrically separated from each other as illustrated in FIG. 11. That is, the first and second bussbars 1 and 2 are electrically separated from each other.

On the contrary, when a problem occurs in the circuit, an electrical signal is applied to the explosive actuator 9 and the explosive actuator 9 explodes. As the explosive actuator 9 explodes, high-pressure gas is ejected and pushes the piston member 8. The piston member 8 pushes the magnetic member 7, the insulation member 6, and the movable contactor 5*b* such that the movable contactor 5*b* contacts the fixed contactor 5*a*. Here, the compressed state of the spring 4 is released and the spring 4 pushes the insulation member 6 and the movable contactor 5*b* toward the installed fixed contactor 5*b* to maintain a state in which the fixed and movable contactors 5*a* and 5*b* are in contact with each other. Accordingly, the fixed and movable contactors 5*a* and 5*b* are electrically connected to each other. That is, the first and second bussbars 1 and 2 are electrically connected to each other.

As described above, since in the bypass switch for HVDC transmission according to an embodiment, the piston member 8 pushes the movable contactor 5*b* due to the operation of the explosive actuator 9, there is a merit in that a high speed operation is possible.

Also, in the bypass switch for HVDC transmission according to an embodiment, the magnet 10 functions to maintain the magnetic member 7 in an initial state, and the spring 4 functions to maintain the state after the movable contactor 5*b* contacts the fixed contactor 5*a*. Accordingly, since a coil for moving a separate axis is not required, there is a merit in that the bypass switch may be manufactured to have a small volume.

According to embodiments, there is a merit in that the movable contactor may be more quickly operated to quickly block the circuit than in the case of using a coil armature to operate the movable contactor.

Also, there is a merit in that the magnetic member, the magnet, and the spring may be compactly installed, and the overall size may be minimized.

Also, there is a merit in that the movable contactor and the fixed contactor may be maintained in stable contact with each other.

Also, there is a merit in that the movable contactor is prevented from suffering a malfunction caused by the magnet and the magnetic member, and has high reliability.

Also, there is a merit in that services such as the replacement or repair of the explosive actuator are easy.

Although the present invention has been described through the embodiments and the accompanying drawings, the scope of the present invention is not limited thereto, and those skilled in the art will appreciate that simple modifications are possible, without departing from the scope and spirit of the invention as disclosed in the accompanying claims. For example, each component shown in detail in the exemplary embodiments may be modified and implemented. In addition, it should be understood that differences associated with such modifications and implementations are included in the scope of the present invention defined in the appended claims.

What is claimed is:

1. A bypass switch for high voltage direct current (HVDC) transmission, the bypass switch comprising:
- a housing;
- a fixed contactor disposed in the housing and electrically connected to a first portion of an HVDC transmission circuit;
- a movable contactor movably disposed in the housing at a position spaced apart from the fixed contactor and electrically connected to a second portion of the HVDC transmission circuit;
- an insulation member coupled to the movable contactor;
- an explosive actuator configured to be exploded according to an electrical signal; and
- a piston mechanism configured to:
- move in response to a force applied by gas generated due to explosion of the explosive actuator;
- apply a force to cause movement of the insulation member and
- cause the fixed contactor and moveable contactor to be electrically connected to each other,
- wherein the piston mechanism comprises:
- a piston member configured to be moved in response to the force applied by the gas; and
- a magnetic member coupled to and positioned between the insulation member and the piston member and configured to transfer force from the piston member to the insulation member.

2. The bypass switch according to claim 1, wherein the explosive actuator comprises
- an inflator injecting gas, and
- an inflator cover coupled to the inflator,
- wherein the inflator cover includes an inner space in which the gas injected from the inflator flows to the piston member and the piston member is movably disposed.

3. The bypass switch according to claim 1, further comprising a magnet holding the magnetic member such that the magnetic member is inserted into the magnet and the movable contactor is spaced apart from the fixed contactor before the explosive actuator operates.

4. The bypass switch according to claim 1, wherein the magnetic member is provided in a cylindrical shape, and a magnet is provided in a shape of a hollow cylinder such that the magnetic member is disposed therein.

5. The bypass switch according to claim 1, further comprising a frame defining a space accommodating the housing, wherein a magnet is disposed in the frame.

6. The bypass switch according to claim 1, further comprising a spring disposed around a magnet and applying force to the insulation member.

7. The bypass switch according to claim 6, comprising:
- a first frame;
- a second frame;
- a third frame coupled to the fixed contactor and supported by the first and second frames; and
- a fourth frame coupled to the explosive actuator and supported by the first and second frames.

8. The bypass switch according to claim 7, wherein the magnet is coupled to and supported by the fourth frame, and the spring is disposed between the insulation member and the fourth frame.

9. The bypass switch according to claim 1, further comprising:
- a first bussbar electrically connected to the fixed contactor; and
- a second bussbar electrically connected to the movable contactor.

10. The bypass switch according to claim 9, wherein the second bussbar is disposed between the movable contactor and the insulation member and contacts the movable contactor and the insulation member.

11. The bypass switch according to claim 10, wherein the insulation member includes a protrusion which penetrates a through hole provided in the second bussbar and is coupled to an insertion groove provided in the movable contactor.

12. The bypass switch according to claim 1, wherein the housing is a vacuum housing and further comprises a bellows disposed between the movable contactor and the housing in the housing.

13. The bypass switch according to claim 12, wherein the vacuum housing is formed of an insulation material.

14. The bypass switch according to claim 1, further comprising a frame defining a space accommodating the housing, wherein the explosive actuator is disposed in the frame.

15. A bypass switch for high voltage direct current (HVDC) transmission, the bypass switch comprising:
- a frame defining a space therein; a housing disposed in the space;
- a fixed contactor disposed in the housing;
- a first bussbar connected to the fixed contactor;
- a movable contactor movably disposed in the housing at a position spaced apart from the fixed contactor;
- a second bussbar connected to the movable contactor;
- an insulation member coupled to the movable contactor;
- an explosive actuator disposed in the frame and configured to be exploded according to an electrical signal;
- a piston mechanism configured to:
- move in response to a force applied by gas generated due to explosion of the explosive actuator
- apply a force to cause movement of the insulation member; and cause the moveable contactor to make contact with the fixed contactor; and
- a spring disposed between the insulation member and the frame and configured to apply force to the insulation member,
- wherein the piston mechanism comprises:
- a piston member configured to be moved in response to the force applied by the gas; and a magnetic member coupled to and positioned between the insulation member and the piston member and configured to transfer force from the piston member to the insulation member.

16. The bypass switch according to claim 15, wherein the frame comprises a through hole into which a portion of the explosive actuator is inserted.

17. The bypass switch according to claim 15, further comprising a magnet disposed in the frame and holding the magnetic member such that the magnetic member is inserted into the magnet and the movable contactor is spaced apart from the fixed contactor before the explosive actuator operates.

18. The bypass switch according to claim 15, wherein the spring is positioned at an outer circumferential surface of a magnet.

* * * * *